United States Patent [19]

Wilson

[11] Patent Number: 4,775,325

[45] Date of Patent: Oct. 4, 1988

[54] ELECTRICAL CONNECTOR

[75] Inventor: Ronald A. Wilson, Medway, Mass.

[73] Assignee: Microwave Development Laboratories, Needham, Mass.

[21] Appl. No.: 864,739

[22] Filed: May 13, 1986

Related U.S. Application Data

[63] Continuation-in-part of Ser. No. 729,642, May 2, 1985, abandoned, which is a continuation-in-part of Ser. No. 610,268, May 14, 1984, abandoned, which is a continuation-in-part of Ser. No. 579,404, Feb. 13, 1984, abandoned.

[51] Int. Cl.[4] ..... H01R 13/405; H01R 17/04

[52] U.S. Cl. ..... 439/278; 439/675; 439/578; 439/736

[58] Field of Search ..... 339/94 M, 218 R, 218 M, 339/60 R, 60 C, 94 C, 177 R, 177 E, 177 L; 439/271-282, 587-589, 675, 736, 869, 578-585

[56] References Cited

U.S. PATENT DOCUMENTS

| | | | |
|---|---|---|---|
| 2,590,761 | 3/1952 | Edgar | 308/237 |
| 2,984,811 | 5/1961 | Hennessey, Jr. et al. | 339/94 M |
| 3,107,950 | 10/1963 | Kleven | 308/36 |
| 3,311,431 | 3/1967 | Hilliard | 308/189 |
| 3,359,047 | 12/1967 | Andersen | 308/36 |
| 4,360,245 | 11/1982 | Nikitas | 339/218 R |

*Primary Examiner*—Gil Weidenfeld
*Assistant Examiner*—Gary F. Paumen
*Attorney, Agent, or Firm*—Wolf, Greenfield & Sacks

[57] ABSTRACT

An electrical connector having inner and outer conductors along with a sleeve. The outer conductor has an inwardly directed annular ridge adapted to interlock with the sleeve. The sleeve is preferably of teflon. In order to maintain contact between the sleeve and the annular ridge of the outer conductor with changes in temperature, the length of the ridge is related to the diameter of the sleeve at each point along the slope of the end slope of the ridge by the equation $L=D \tan \theta$. The angle related in the equation is the end bevel angle on the ridge and when this angle is on the order of 45°, then the relationship reduces to one in which the length of the ridge is comparable to the diameter of the sleeve in order to maintain contact over a temperature change range.

4 Claims, 4 Drawing Sheets

$L2' = L1' \times b \times \Delta T \quad D2' = D1' \times b \times \Delta T$

ELECTRICAL CONNECTOR

RELATED APPLICATIONS

This is a continuation-in-part of application Ser. No. 729,642, filed 5-2-85 now abandoned, which in turn is a continuation-in-part of application Ser. No. 610,268, filed 5-14-84 now abandoned, which in turn is a continuation-in-part of application Ser. No. 579,404, filed 2-13-84 now abandoned.

BACKGROUND OF THE INVENTION

The present invention relates in general to an electrical connector which may be of the jack-to-jack or barrel connector type including a center conductor and an outer conductor. More particularly, the present invention relates to an improvement in connectors of this general type so that the connector is air pressure tight. In accordance with the improved connector of the invention, compensation is made for connector part shrinkage so as to maintain an air pressure tight seal over an extended temperature range.

In my earlier copending application Ser. No. 579,404, an improved technique is described for providing a connector in which the inner and outer conductors are properly positioned relative to each other. The associated method described in this earlier application is an improved method in whyich the connector is made without degrading the electrical characteristics associated with the lines intercoupling the connector.

In addition to improvements set forth in the aforementioned earlier application, it is an object of the present invention to provide a still further improved coaxial connector in which the connector is characterized by having an air pressure tight seal.

Another object of the present invention is to provide an improved coaxial connector in which the connector parts are maintained in a rigid mechanical interconnecting relationship.

Although the foregoing objects are the main objects of the present invention, other objects that will be carried out in constructing the connector of this invention include a method of assembly that is carried out quite easily with few steps.

Another object of the present invention is to provide an improved electrical coaxial connector and associated method of making of the connector in which the connector is made without degrading the electrical characteristics associated with the lines intercoupled by the connector.

Another object of the present invention is to provide an improved coaxial connector design, and one in which the inner and outer conductors are properly positioned relative to each other and are maintained in that position in use over a wide temperature range.

SUMMARY OF THE INVENTION

To accomplish the foregoing and other objects of this invention, there is provided an electrical connector that is comprised of an outer conductor body, an inner conductor adapted to fit within the body and a sleeve adapted to intercouple between the body and the center conductor. In an embodiment disclosed herein, the connector is of the type in which the second conductor may be attached to a circuit or circuit board. In accordance with the method of assembly of the connector, the sleeve is assembled into the body after the center conductor is assembled into the sleeve. The body is provided with an annular ridge so as to snugly receive the sleeve. The outer conductor and the inner conductor are then sealed as a unit and heat is applied to a temperature in excess of the maximum operating temperature corresponding preferably to the rated specification for the connector. The sleeve, which is preferably of Teflon swells to fill any cavities and has cold flow properties that enable it to retain its shape even after the temperature cools. In accordance with the concepts of the present invention, the aforementioned annular ridge is adapted to have a length that relates to the diameter of the sleeve. If the length of the ridge is L, and the diameter is D, then the following equation applies, $L=D \tan \theta$. This equation has been derived in accordance with the present invention and provides a relationship for maintaining proper sealing contact to provide a pressure tight fit. In the foregoing equation, the angle $\theta$ represents the end angle of the ridge. In a preferred embodiment, wherein the angle $\theta=45°$, then from the above equation, this means that the construction is selected so that the length of the ridge is substantially the same as the diameter of the sleeve which in turn is comparable to the inner diameter of the outer conductor body.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
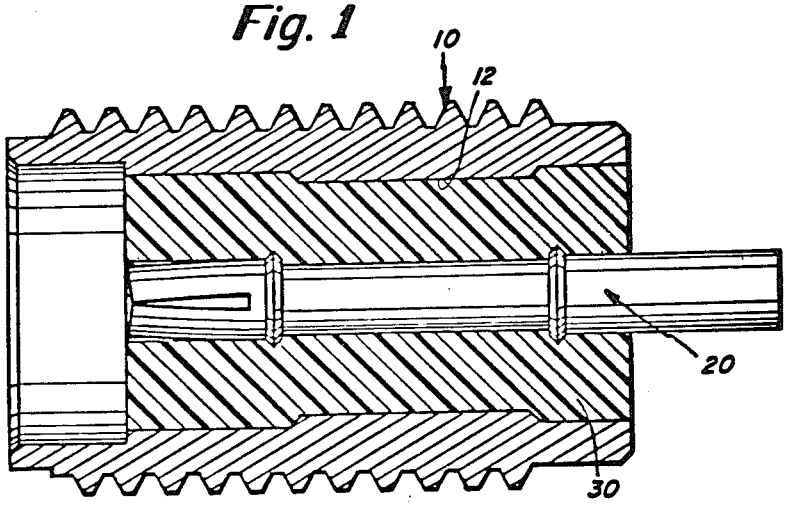
FIG. 1 is a cross-sectional view of a connector constructed in accordance with the present invention.

FIG. 1 is a cross-sectional view of a connector embodying the principles of the present invention. The connector illustrated in FIG. 1 may be for connection to a printed circuit board although it also has other applications. The concepts of the present invention may be employed in connection with the making of any type of connector in which inner and outer conductors are to be relatively supported. For example, the principles of the invention may be applied in constructing connectors such as of the general type illustrated in my aforementioned application Ser. No. 579,404.

Figure 5:
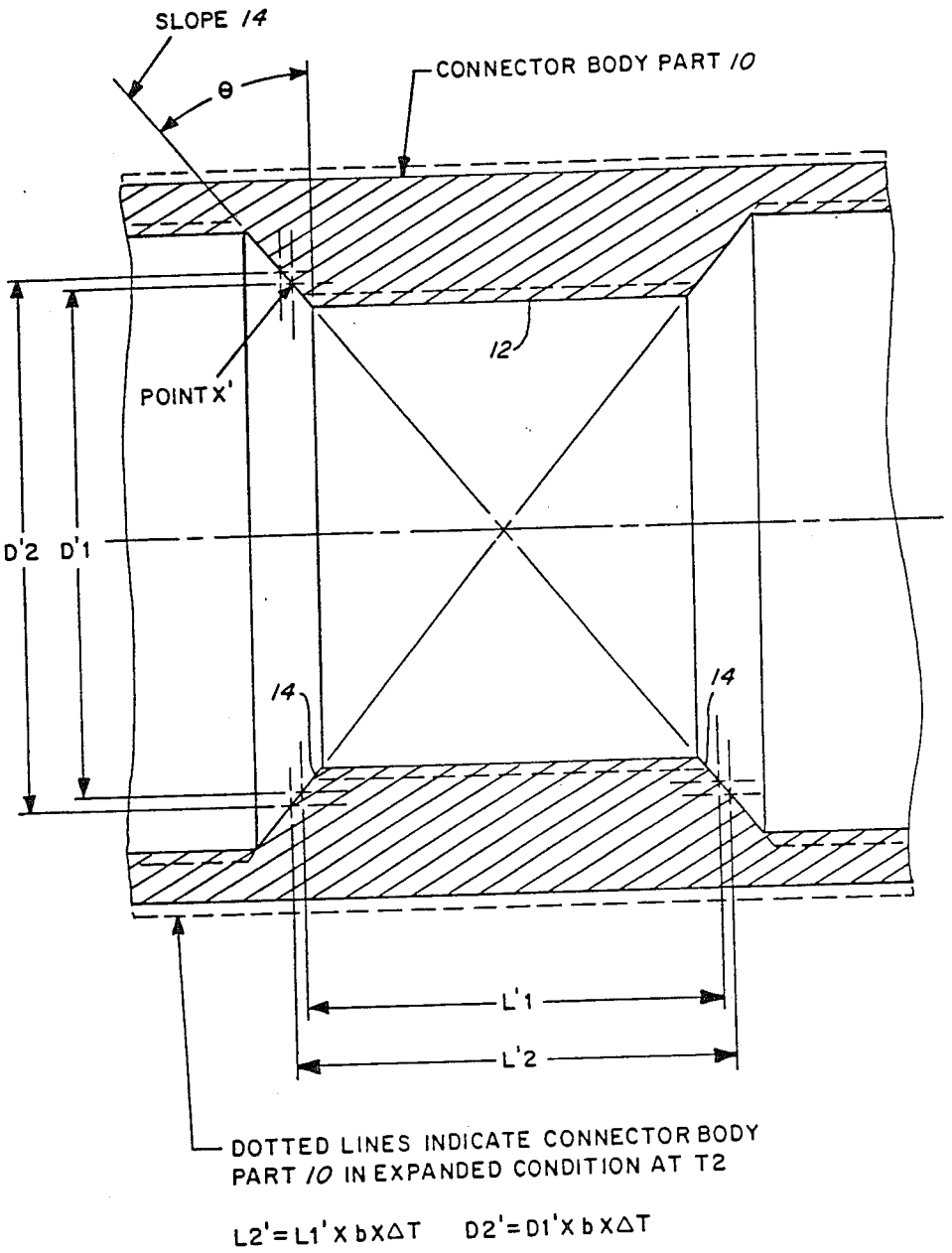

The connector illustrated in FIG. 1 comprises a connector body 10 forming an outer conductor, an inner conductor 20 and a Teflon sleeve 30. Teflon has good cold flow properties which enable it to be heated to conform to the shape of the inner and outer conductors. FIG. 1 illustrates the Teflon sleeve in its final shape. Initially, the Teflon sleeve may be of the size and shape as illustrated in FIG. 5 of application Ser. No. 579,404.

Briefly, in accordance with the method of manufacture, the Teflon sleeve 30 is assembled into the body 10 so that it extends along the bore length of the body. The bore length is substantially the same length as the length of the Teflon sleeve and may also be the same as the length of the center conductor. The next step is assembling of the center conductor into the Teflon sleeve while at the same time maintaining the Teflon sleeve in place in the outer conductor. The assembly operations occur without the application of any heat.

Reference may also now be made to my copending application referred to hereinbefore in which the subsequent steps of manufacture include plugging the ends of the connector, and applying heat. The connector is heated to a maximum temperature which preferably exceeds the rated specification for the connector. The preferred temperature for heating is on the order of 165° C. Cold flow is faster at this temperature. The Teflon is a good insulator and also has good cold flow characteristics allowing expansion thereof as the heat is applied.

When the Teflon sleeve 30 is first inserted, because of the existence of the ridge 12, there may be a small gap between the sleeve and the inner bore of the outer conductor 10 at positions other than where the ridge occurs. However, when the heating occurs, the Teflon expands and fills this void and is essentially interlocked about the inwardly directed annular ridge or ring 12. FIG. 1 illustrates the Teflon having been heated and expanded to essentially fill and match the contour of the inner bore of the outer conductor 10. Also, with respect to the center conductor 20, the Teflon expands about the center conductor and in particular expands into the annular channels that are provided in the center conductor. Thus, the Teflon experiences expansion toward the outer conductor to interlock with the ridge 12 and also experiences inward expansion to interlock with the center conductor and thus provide an overall interlocking between the inner and outer conductors.

Figure 2:
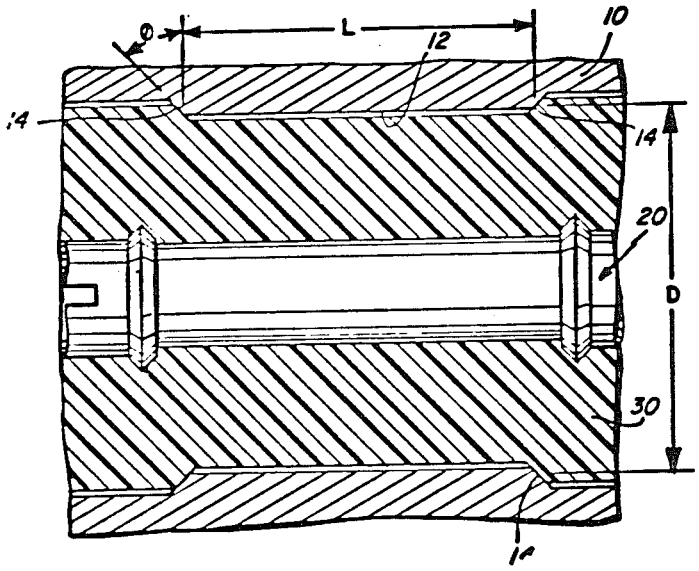
FIG. 2 is a somewhat enlarged fragmentary view of a part of the connector illustrating the principles of the invention.
Figure 3:
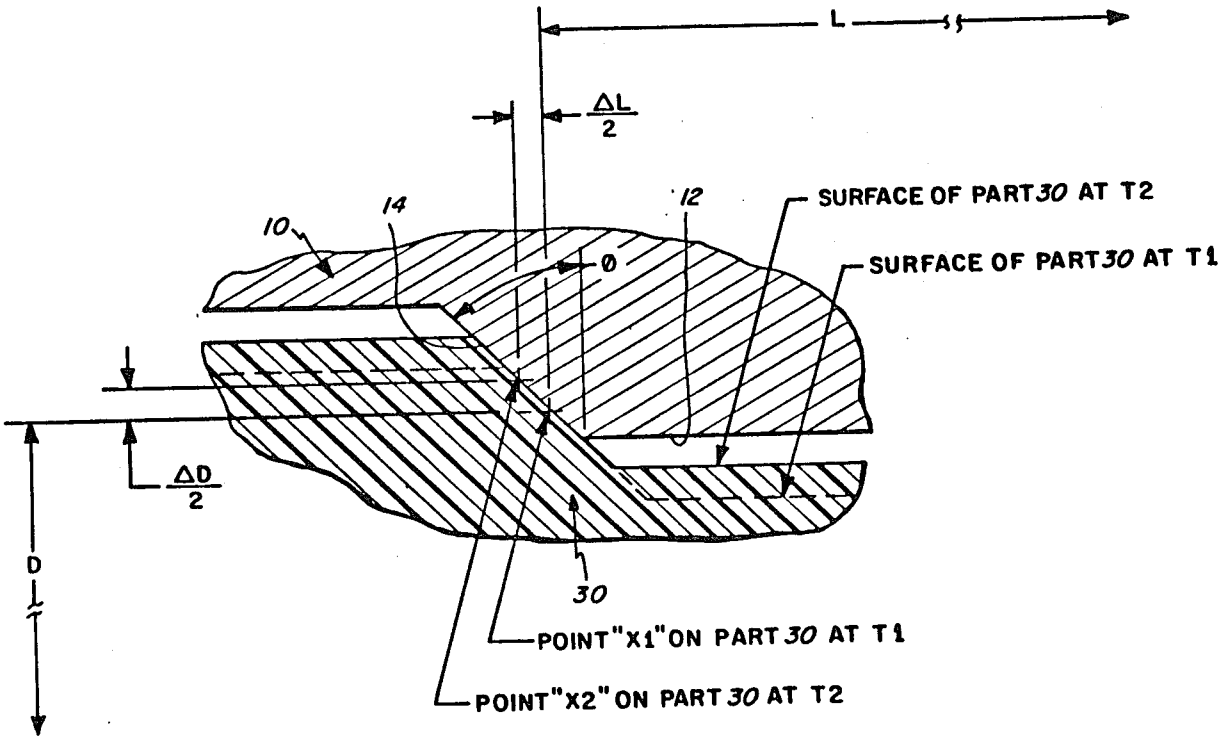
FIG. 3 is still a further fragmentary view showing connector part dimensional relationships at different temperatures.

FIGS. 2 and 3 are enlarged fragmentary views of a portion of the connector shown in FIG. 1. These fragmentary views are instrumental in explaining the principles of the present invention as they relate to certain dimensional parameters that are set forth.

In application Ser. No. 579,404, it is noted that the ridge 14 such as illustrated in FIG. 6 therein was of a relatively short dimension lengthwise and when shrinkage occurred, this did provide for some tightening to maintain interlocking, but did not provide a pressure tight seal. However, now in accordance with the principles of this invention, there is provided a relationship between the mean diameter of the sleeve and the length of the ridge so as to maintain contact between the sleeve and outer conductor even though shrinkage occurs, and to maintain this contact sufficiently so as to provide an essentially air tight pressure seal while maintaining a solid mechanical connection between the connector parts.

Thus, in connection with FIGS. 2 and 3, there is provided a fragmentary view illustrating, in particular, the area of the connector at the annular ridge 12 of the outer conductor 10. Between the views of FIGS. 2 and 3 there is illustrated important dimensions including the length L of the ridge 12 and the diameter D which is the mean diameter of the sleeve 30. The drawing also shows the angle $\theta$ which is the angle on the beveled end 14 of the ridge 12.

FIG. 3, in particular, is an expanded fragmentary view of the end of annular ridge 12, showing the changes of part 30 relative to part 10 with a change in temperature. In FIG. 3 the part 10 is considered stationary for the sake of the following derivations. Note that the part 30 is shown in solid in connection with its position relating to temperature T2 and is shown in dotted with relationship to its position in connection with temperature T1.

For materials commonly used in high frequency electrical connectors, the outer conductor or part 10 is normally metallic while the inner sleeve or part 30 is an insulator, normally plastic. Most metals have a much lower coefficient of expansion than plastics and thus the following derivation and the geometries of the drawing illustrate that particular case, although, the concepts of the invention will also apply for other combinations of materials including those in which the outer part has a higher coefficient of expansion than the inner part.

Figure 4:
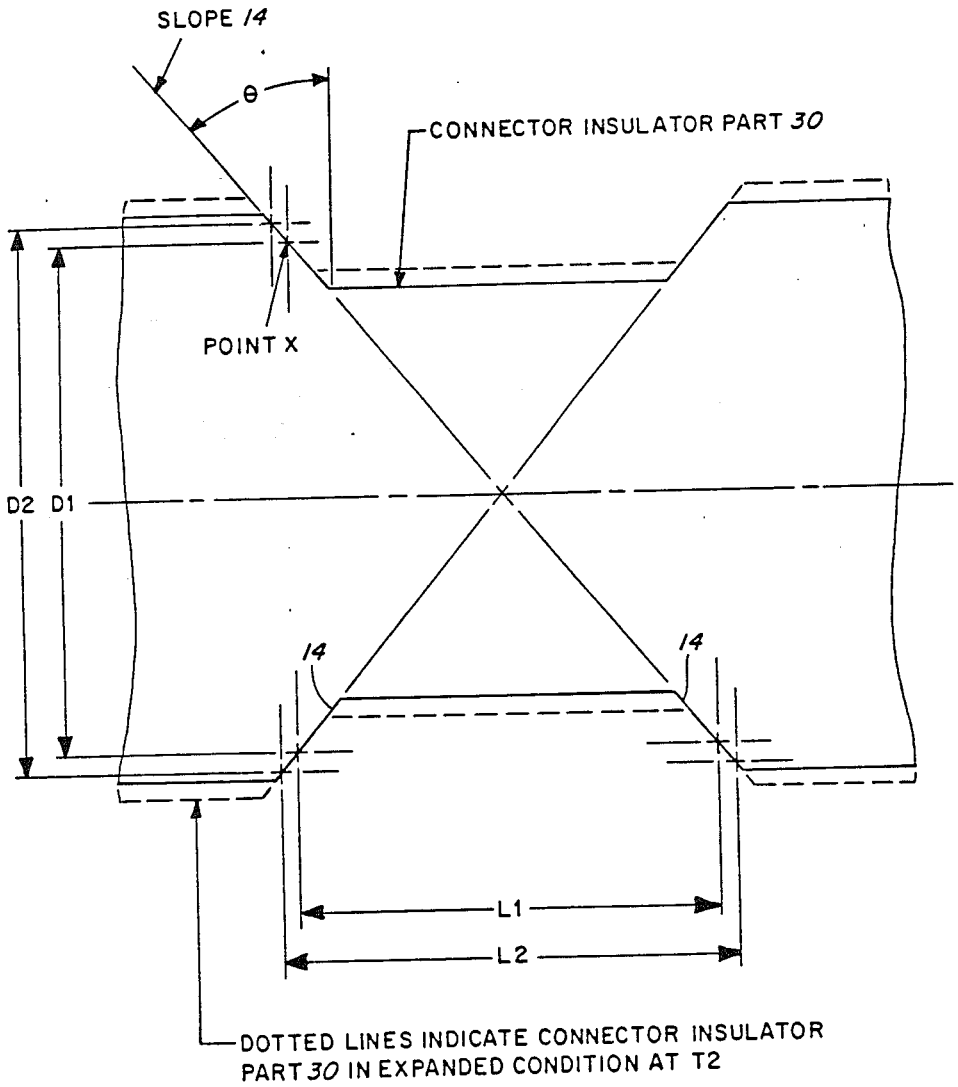
FIGS. 4 and 5 are partial schematic views used to illustrate the relative movement between the beveled end walls of the connector body and sleeve during a change in temperataure.

The parts of a connector fabricated in accordance with the above-identified patent application maintain mechanical contact and a tight fight over a range of temperatures. The connector includes a connector body comprising an outer conductor having an axially symmetrical bore with an internal ridge of axial length L and diameter D as shown in FIG. 4. The internal ridge is beveled at an angle $\phi$ at each end, wherein $\phi$ is measured with respect to a plane perpendicular to the axis of the bore. A connector insulator having a groove complementary with the internal ridge in the connector body and beveled at an angle $\phi$ at each end is positioned in the bore as shown in the drawing attached hereto as FIG. 5. When the connector is assembled, the insulator is positioned in the bore of the connector body with the internal ridge of the connector body interengaged with the groove in the insulator. In accordance with the teachings of the above-identified patent application, the internal ridge and the groove are fabricated so that $L/D=\tan\phi$. The following analysis proves that when the relationship is maintained, the connector body and the connector insulator will remain in contact along the beveled ends of the internal ridge and the groove.

With reference to insulator part 30 shown in FIG. 5, as the temperature changes from T1 to T2, a point x on the beveled end of the groove moves from the point defined by L1, D1 to the point defined by L2, D2 due to expansion of the part 30. The change in location of point x in the radial direction $\Delta D/2$ is given by $$\frac{\Delta D}{2} = \frac{D1 \cdot a \cdot \Delta T}{2} \tag{6}$$

where

D1=diameter of part 30 at the point x a=coefficient of expansion of part 30

$\Delta T$=change in temperature=T2−T1

Similarly, the change in location of point x in the axial direction $\Delta L/2$ is given by $$\frac{\Delta L}{2} = \frac{L1 \cdot a \cdot \Delta T}{2} \tag{7}$$

wherein L1=length of internal ridge at point x A line drawn through point x at T1 and point x at T2 is inclined at an angle $\theta$ with respect to vertical. By trigonometric definition, $$\tan\theta = \frac{\Delta L}{2} \div \frac{\Delta D}{2} = \frac{L1 \cdot a \cdot \Delta T}{D1 \cdot a \cdot \Delta T} = \frac{L1}{D1} \tag{8}$$

From equation (8), it can be seen that $\theta$ which defines the line along which point x moves, equals $\phi$, the angle of the beveled groove end only when $\tan\phi=L/d$. This means that the two lines are congruent, and point x moves in the direction of the beveled end surface during thermal expansion and contraction.

A similar analysis is applied to connector body part 10 shown in FIG. 4. As the temperature changes from T1 and T2, a point x' on the beveled end of the internal ridge moves from the point defined by L1', D1' to the point defined by L2', D2' due to the expansion of part 10. The change in the location of point x' in the radial direction $\Delta D'/2$ is given by $$\frac{\Delta D'}{2} = \frac{D1' \cdot b \cdot \Delta T}{2} \quad (9)$$

where

D1'=diameter of part 10 at point x' b=the coefficient of expansion of part 10. Similarly, the change in location of point x' in the axial direction $\Delta L'/2$ is given by $$\frac{\Delta L'}{2} = \frac{L1' \cdot b \cdot \Delta T}{2} \quad (10)$$

wherein L1'=length of groove at point x'

A line drawn through point x' at T1 and through point x' at T2 is inclined at an angle $\theta'$ with respect to vertical. By trigonometric definition, $$\tan\theta' = \frac{\Delta L'}{2} \div \frac{\Delta D'}{2} = \frac{L1' \cdot b \cdot \Delta T}{D1' \cdot b \cdot \Delta T} = \frac{L1'}{D1'} \quad (11)$$

From equation (11), it can be seen that $\theta'$, which defines the line along which point x' moves, equals $\phi$, the angle of the beveled ridge end, only when $\tan\phi = L/D$. This means that the two lines are congruent, and point x' moves in the direction of the beveled end surface during thermal expansion and contraction. When connector body part 10 and connector, insulator part 30 are assembled together so that D1=D1' and L1=L1', both part 20 and part 30 move in the direction of the line defined by $\phi$ during thermal expansion and contraction. The parts remain in contact along the beveled ends of the ridge and groove, even though they slide relative to each other due to differing coefficients of expansion.

The above proof can be interpreted as follows. When the parts are constructed so that $L/D = \tan\phi$, lines drawn through the beveled ends of the ridge and the beveled ends of the groove intersect at a common point P on the axis of the parts and at the mid-points of the ridge and the groove. If the point P is considered as the center of expansion for each part, then thermal expansion causes radial movement of any arbitrary point in the part with respect to the center of expansion. Points on the beveled ends of the ridge and the groove move radially in the direction of the beveled ends during a temperature change and thereby remain on the same radial line. This holds true for both parts regardless of differing coefficients of expansion. The important result is that the parts remain in contact at the beveled ends of the internal ridge and the groove and simply slide relative to each other over these angled surfaces during a temperature change, as illustrated in FIG. 3. Therefore, the parts remain in contact on these angled surfaces even though they do not remain in contact over their nonangled portions due to the differing coefficients of expansion. The connector thereby maintains mechanical contact and tight fit between parts over a temperature range in spite of differing coefficients of expansion.

Having described a limited number of embodiments of the present invention, it should now be apparent to those skilled in the art that numerous other embodiments are contemplated as falling within the scope of this invention.

What is claimed is:

1. An electrical connector comprising: an outer conductor connector body having a center bore with there being defined in the center bore, an inwardly directed annular ridge extending into the bore, a sleeve in the outer conductor body bore and adapted under heat and expansion to be mated substantially therewith forming an annular recess that interlocks with said annular ridge, and an inner conductor adapted to fit within said sleeve, said annular ridge having a length L and having at opposite sides thereof beveled end walls transitioning between the outer conductor body bore and annular ridge, the length L being measured in an axial direction between spaced symmetric points at said respective beveled end walls, said sleeve having a mean diameter D, the diameter D being measured in a normal direction to the connector axis between spaced symmetric points at either one of said respective beveled end walls, said annular recess also having a length of substantially L and having at opposite sides thereof recess defining beveled end walls transitioning between the outer diameter of the sleeve and the inner diameter of the sleeve, the beveled end walls of both said ridge and said recess being in contact and at the same angle $\theta$ measured from a plane normal to the connector axis to the beveled end wall, whereby, to maintain pressure tight coupling and a fixed mechanical positioning between the outer conductor and sleeve, the length L is relative to the diameter D and the angle $\theta$, irrespective of the relative coefficients of expansion of the connector body and sleeve, by the following equation:

$$L = D \tan\theta$$

whereby, during expansion and contraction, the relative movement between the beveled end walls of the connector body and sleeve is along the line defined by said equation.

2. A electrical connector as set forth in claim 1 wherein said center conductor has spaced annular ribs with each rib being substantially in line with one of said beveled end walls.

3. An electrical connector as set forth in claim 1 wherein the length of the annular ridge is comparable to the mean diameter of the sleeve in the case where the angle $\theta$ is on the order 45°.

4. An electrical connector as set forth in claim 1 wherein the annular ridge has a trapezoidal cross-section including the beveled end walls.

* * * * *